US008966663B2

(12) United States Patent
Binge et al.

(10) Patent No.: US 8,966,663 B2
(45) Date of Patent: Mar. 3, 2015

(54) PROTECTIVE GLOVE HAVING AN ARCHED PANEL

(71) Applicant: Warrior Sports, Inc., Warren, MI (US)

(72) Inventors: William G. Binge, Clarkston, MI (US); Dale W. Kohler, Metamora, MI (US)

(73) Assignee: Warrior Sports, Inc., Warren, MI (US)

( * ) Notice: Subject to any disclaimer, the term of this patent is extended or adjusted under 35 U.S.C. 154(b) by 201 days.

(21) Appl. No.: 13/746,944

(22) Filed: Jan. 22, 2013

(65) Prior Publication Data

US 2014/0201880 A1 Jul. 24, 2014

(51) Int. Cl.
*A41D 13/08* (2006.01)
*A63B 71/14* (2006.01)

(52) U.S. Cl.
CPC ..... *A63B 71/141* (2013.01)
USPC ..... 2/16

(58) Field of Classification Search
CPC ..... A63B 71/141
USPC ..... 2/158, 159, 160, 161.1, 161.5, 161.6
See application file for complete search history.

(56) References Cited

U.S. PATENT DOCUMENTS

| | | | |
|---|---|---|---|
| 889,397 | A | 6/1908 | O'Shaughnessy |
| 1,841,193 | A | 1/1932 | Lidston |
| D257,909 | S | 1/1981 | Brine |
| 4,930,162 | A | 6/1990 | Cote |
| 5,745,916 | A | 5/1998 | Linner |
| 5,787,506 | A | 8/1998 | Wilder et al. |
| 5,983,396 | A | 11/1999 | Morrow et al. |
| 6,085,354 | A | 7/2000 | Wilder et al. |
| 6,122,769 | A | 9/2000 | Wilder et al. |
| D446,888 | S | 8/2001 | Morrow |
| 6,550,069 | B1 | 4/2003 | Morrow |
| 6,643,844 | B2 | 11/2003 | Morrow et al. |
| 6,799,333 | B2 | 10/2004 | Morrow et al. |
| 6,813,780 | B2 | 11/2004 | Morrow |
| 7,114,193 | B2 | 10/2006 | Winningham |
| 7,117,540 | B2 | 10/2006 | Morrow |
| 7,318,241 | B2 | 1/2008 | Morrow |
| 7,530,120 | B2 | 5/2009 | Morrow et al. |
| 7,620,999 | B2 | 11/2009 | Winningham |
| 7,636,951 | B2 | 12/2009 | Morrow et al. |
| D626,696 | S | 11/2010 | Winningham |
| 7,836,521 | B2 | 11/2010 | Winningham |
| 7,841,023 | B2 | 11/2010 | Winningham |
| 7,861,321 | B2 | 1/2011 | Winningham |
| 7,900,275 | B2 | 3/2011 | Morrow et al. |
| 8,141,175 | B2 | 3/2012 | Winningham |
| 8,201,272 | B2 | 6/2012 | Winningham |
| 8,341,767 | B2 | 1/2013 | Winningham |

(Continued)

*Primary Examiner* — Danny Worrell
*Assistant Examiner* — Anna Kinsaul
(74) *Attorney, Agent, or Firm* — Warner Norcross & Judd LLP

(57) ABSTRACT

A protective sports glove including a vent opening and an arched panel extending upward and over the vent opening. The glove can include a breathable material that extends across the vent opening to provide improved air flow to and from the interior of the glove. The arched panel can arch above the vent opening, and optional breathable material, so as to form a void under the panel, thereby providing impact protection to the wearer's hand while still enabling air to circulate through the vent opening to the wearer's hand. The arched panel can be configured to flex or bend when the hand is brought back toward the wearer's wrist or forearm, yet provide resistance to that backward movement to eliminate and/or reduce the overextension of the hand and wrist.

19 Claims, 7 Drawing Sheets

(56) References Cited

U.S. PATENT DOCUMENTS

| | | | | |
|---|---|---|---|---|
| 2005/0091721 | A1 | 5/2005 | Best | |
| 2010/0058513 | A1 | 3/2010 | Drosihn et al. | |
| 2010/0281599 | A1* | 11/2010 | Fiegener et al. | 2/161.1 |
| 2011/0067165 | A1 | 3/2011 | Fream et al. | |
| 2011/0131703 | A1 | 6/2011 | Mazzarolo | |
| 2012/0204304 | A1 | 8/2012 | Pechtold | |
| 2012/0297514 | A1 | 11/2012 | Aoki et al. | |
| 2013/0061369 | A1 | 3/2013 | Lim | |

* cited by examiner

PROTECTIVE GLOVE HAVING AN ARCHED PANEL

BACKGROUND OF THE INVENTION

The present invention relates to a protective glove and, more particularly, to a protective sports glove having one or more vents to improve circulation to a wearer's hand within the glove, while still providing adequate impact protection.

In many contact sports, such as lacrosse or hockey, sticks are elements of the game. A player's hands, wrists, and lower arms are especially vulnerable to injury when being checked by another player's stick. For this reason, players typically wear padded gloves to protect their hands, wrists and lower arms during play.

Typical gloves for such contact sports generally include a hand portion joined with finger portions and a thumb portion. The hand portion, finger portions, and thumb portion each have a respective palm portion and a dorsal portion. The dorsal portion usually is covered with multiple protective pads to protect the dorsal side of the hand from forceful impacts and blows.

The protective pads on the dorsal portions are thick, and frequently include an air impervious rigid plate or other material. Accordingly, the dorsal portion of many gloves restricts air flow to the wearer's hand inside the glove. This can lead to excessive perspiration and general discomfort to the wearer during extended play and/or play in hot or humid conditions.

Some manufacturers have attempted to solve the air flow issue by providing vents that extend from the interior of the glove to the exterior of the glove, sometimes within seams between pads, or through the pads themselves. This construction usually is a compromise because the vents must be relatively small so that the hand is still protected by enough padding. Where the vents are large, and the padding is significantly reduced, the likelihood of injury to the hand might be increased. Thus, there is a trade-off between enough padding and sufficient venting to provide adequate ventilation.

SUMMARY OF THE INVENTION

A protective sports glove, including a vent opening and an arched panel extending upward and over the vent opening, is provided. In one embodiment, the glove can include optional breathable material that extends across the vent opening to provide improved air flow to and from an interior of the glove. The arched panel can arch above the vent opening and optional breathable material so as to form a void under the panel, thereby providing impact protection to the wearer's hand while still enabling air to circulate through the vent opening.

In another embodiment, the arched panel can be configured to flex or bend when the hand is brought back toward the wearer's wrist or forearm, yet provide some resistance to that backward movement to reduce or impair the overextension of the hand and wrist.

In still another embodiment, the panel, due to its arched shape, can provide an added level of impact absorption and protection to the dorsal side of the hand. The arched panel can flex or bend when a blow is imparted to it, thereby dissipating the blow or force. The arched panel also can compress or bend to offer a deceleration zone within which the impacting object is decelerated before the force is transmitted to the wearer's hand.

In yet another embodiment, the vent opening can be defined in a dorsal portion of the glove. The breathable material can be disposed across the vent opening. The arched panel can arch upward and over the vent opening and/or breathable material so that a void is formed between the vent opening and an underside of the arched panel whereby air can freely circulate under the panel.

In even another embodiment, the panel can include first and second opposing ends distal from one another along a longitudinal axis of the dorsal portion. The first and second ends can be fixedly secured to the dorsal portion of the glove and/or a cuff portion of the glove. Optionally, both ends can be immovably secured to the dorsal portion and/or cuff portion so that the ends cannot substantially move relative to the dorsal portion and/or cuff portion.

In a further embodiment, the panel can be of a smaller dimension or area than the dimension or area of the vent opening and/or the breathable material where included. In this configuration, the vent opening and/or breathable material underlying the panel can be visible when viewed by a viewer from a location generally above the longitudinal axis.

In still a further embodiment, the vent opening can be bounded on opposing sides by lateral padding. The lateral padding can be distanced from opposing sides or edges of the arched panel so that the vent opening and/or breathable material is visible to a viewer above the longitudinal axis.

The present invention provides a well vented glove having good impact protection. The arched panel can act as a shock absorber to blows or forces imparted to the dorsal side of the hand. The shape and configuration of the arched panel over the vent opening also can decelerate objects impacting the glove, and improve air flow to and from the interior of the glove.

These and other features and advantages of the present invention will become apparent from the following description of the invention, when viewed in accordance with the accompanying drawings and appended claims.

These and other objects, advantages, and features of the invention will be more fully understood and appreciated by reference to the description of the current embodiments and the drawings.

Before the embodiments are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENT

Figure 1:
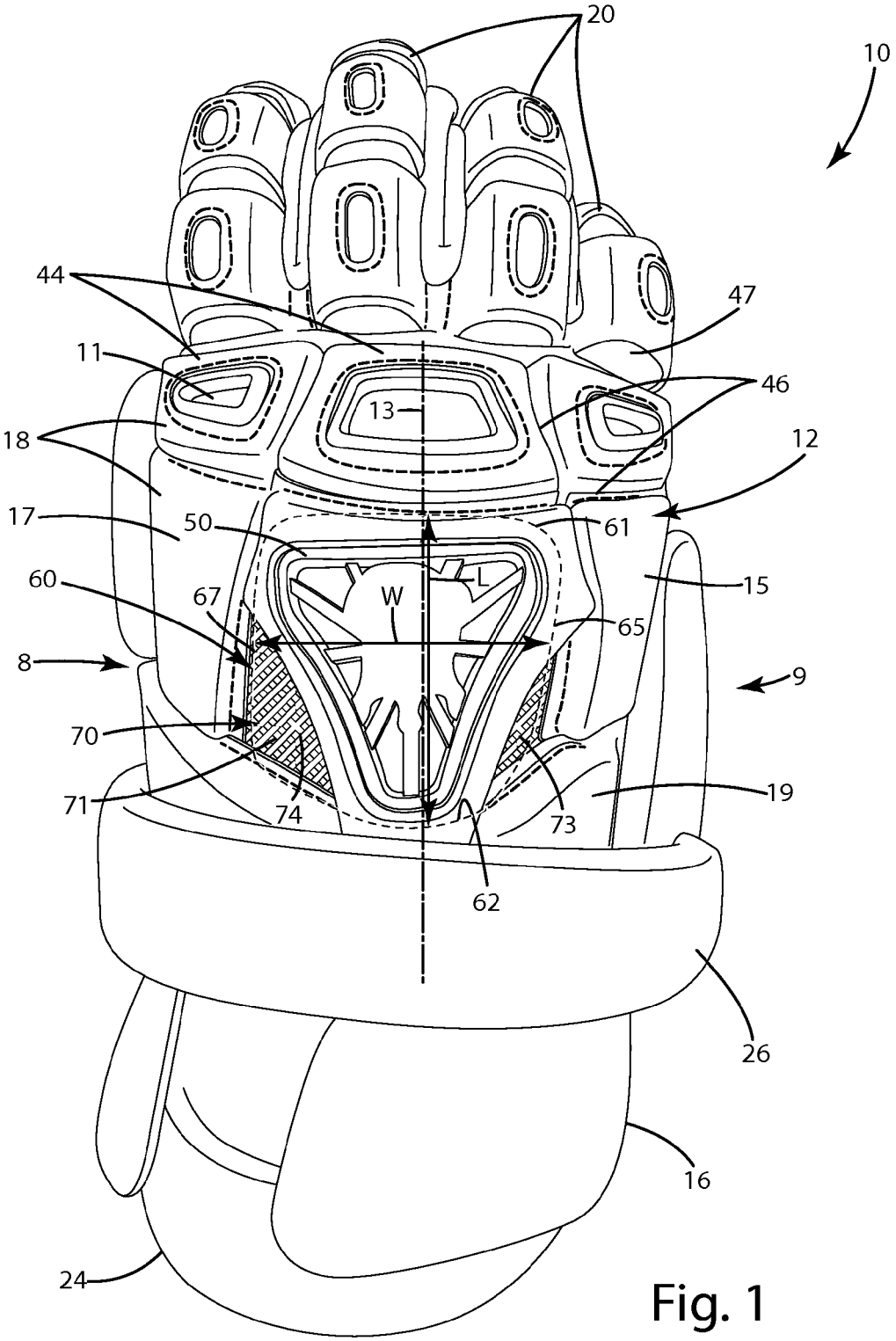
FIG. 1 is a top view of a current embodiment of the glove including an arched panel and vent opening.

A protective sports glove in accordance with a current embodiment is illustrated in FIGS. 1-6 and generally designated 10. While the drawing is illustrative of a right hand glove, the current embodiment can be a left hand glove, which generally is a mirrored version of the right hand glove. Additionally, the glove 10 shown is designed for use in the game of lacrosse; however, it can be used in a variety of other sports or activities, such as hockey, or any activity where a user may move their hand, optionally in the process of manipulating a game stick or other grasped item.

The protective glove can include a back or dorsal portion 12 and a palm portion 14, between which an interior space adapted to receive a wearer's hand is defined. The back portion 12 can be configured so that it is adjacent the dorsal side of a wearer's hand within the glove, while the palmar portion 14 can be adjacent a palmar side of the wearer's hand within the glove.

The glove 10 can include a cuff portion 16, a hand portion 13 joined to the cuff portion 16, a plurality of finger portions 20 extending from the hand portion 13, and a thumb portion 22 extending from the hand portion 13. A floating sub-cuff portion 24 can be disposed under the cuff portion 16. A wrist guard 26 can be positioned over a junction 95 (FIG. 2), which injunction optionally defines a gap 96 between the hand portion 13 and the cuff portion 16. The wrist guard 26 can extend across the lateral 9 and/or medial 8 sides of the glove, as well as the dorsal hand portion 12, partially circumferentiating the wrist and covering the junction 95. If desired, the wrist guard and/or cuff can be eliminated from the glove as well.

Figure 2:
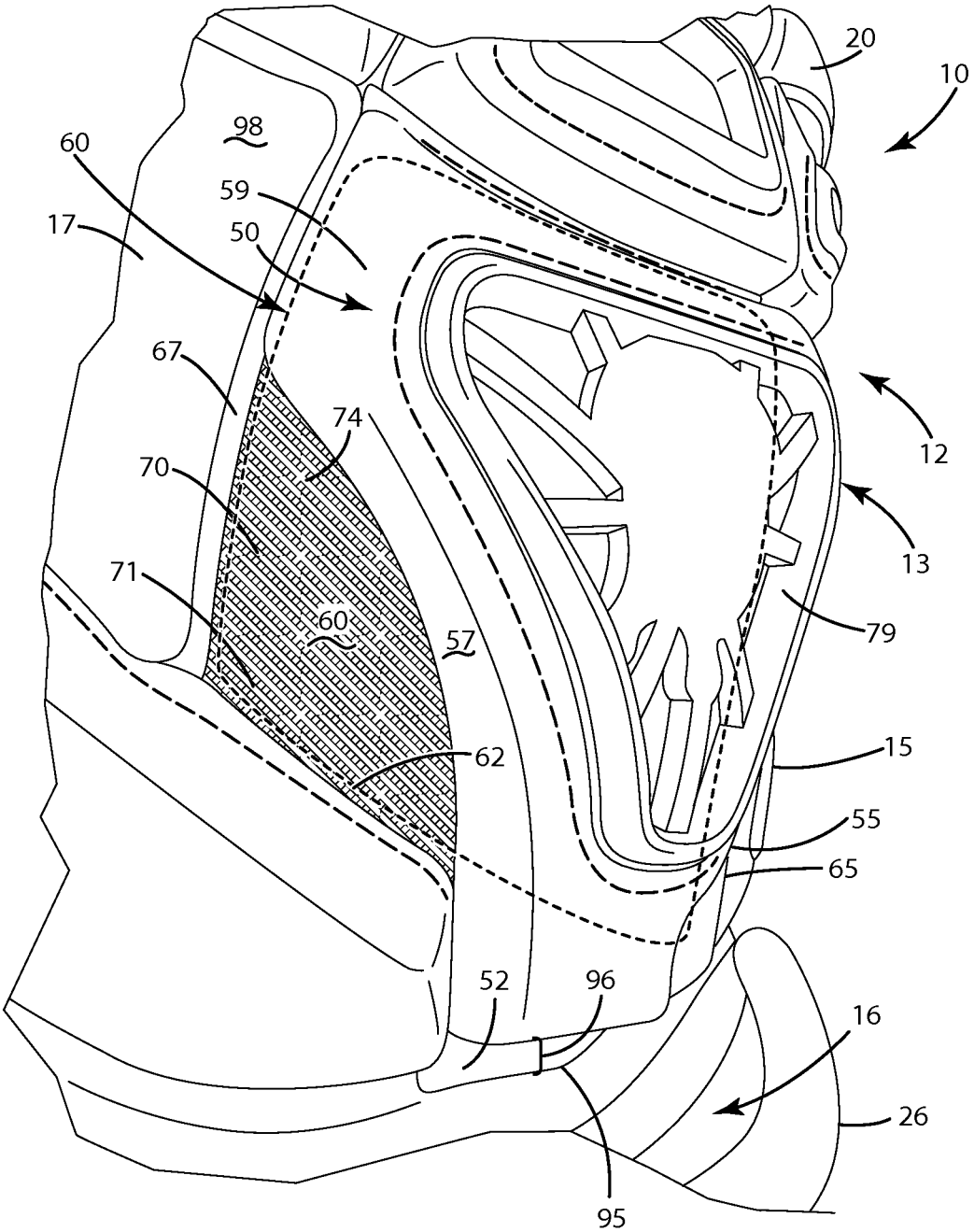
FIG. 2 is a close up perspective view of the glove.
Figure 3:
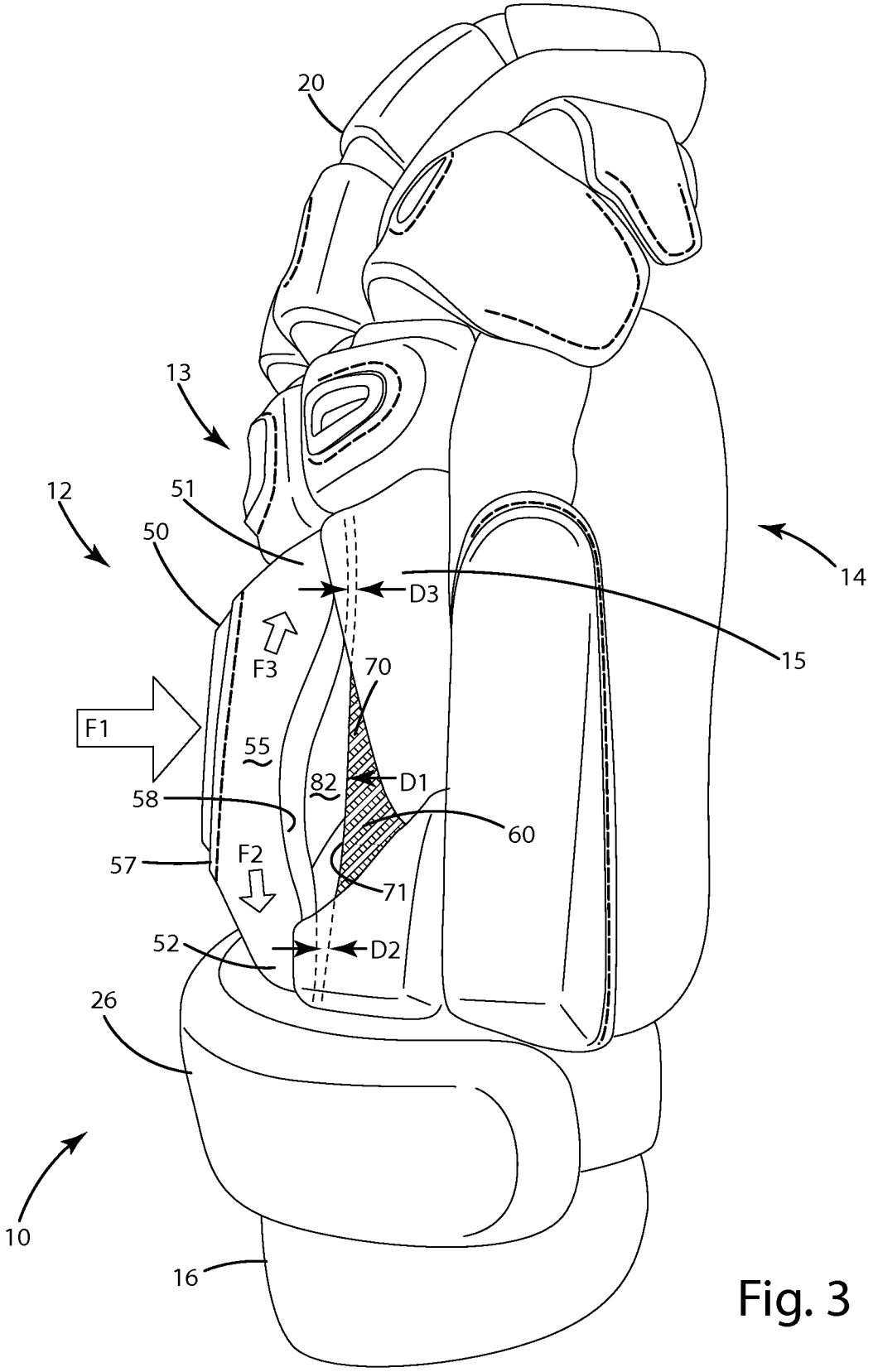
FIG. 3 is a lateral side view of the glove.

As shown in FIGS. 1-3, the hand dorsal portion 12 generally extends between the cuff portion 16 and the finger portions 20. The dorsal portion 12 can include multiple protective portions 18, such as padded portions, secured thereto to provide protection to the rear or back side of a wearer's hand. The protective portions 18 can be constructed from foam, polyurethane, polymers or other suitable materials.

Generally, protective portions can be in the form of pads or panels. For example, the as shown in FIG. 1, the hand dorsal portion 12 is optionally subdivided into multiple protective portions that are sewn into a protective outer material such as a cloth material or the like. Each pair of protective portions can define a respective flex line 46 there between. The flex lines can allow the glove 10 to move as a wearer's hand moves to provide better fit and comfort during play. The flex lines can take on a variety of different configurations and placements as desired.

As shown in FIGS. 1 and 2, the protective portions 44 can terminate at a junction 47 located generally between the hand dorsal portion 12 and the finger portions 20. The junction 47 can allow the finger portions 20 to move with respect to the adjacent protective portions 44 as the junction 47 generally is disposed over a wearer's knuckle area, allowing the finger portions 20 to move as a wearer's fingers flex.

The hand dorsal portion 12 can further define a longitudinal axis 13 generally extending from the cuff portion 16, or generally in the upper center of a wearer's wrist, toward the finger portions 20 of the glove, generally through a center point or location on the wearer's back hand. The longitudinal axis, of course, can be slightly offset from this orientation, yet still provide the desired reference.

The hand dorsal portion 12 can define a vent opening 60, and can include a pad or panel 50 positioned at least partially over that vent opening. Although described in connection with a location on the dorsal side of the glove, the panel and vent opening construction can be implemented anywhere on the glove, for example, on the fingers, the sides of the gloves, the cuff, the wrist and/or elsewhere. Further although shown as a single opening, the vent opening 60 can include multiple vent openings to provide even more ventilation to the wearer's hand. Also, the panel can be reproduced in a variety of different locations across the back of the hand or other portions of the hand.

The vent opening 60 defined by the hand dorsal portion 12 can generally extend laterally across the hand dorsal portion 12 generally from a medial side 8 toward a lateral side 9. Although shown as being generally symmetrical about longitudinal axis 13, the vent opening 60 can be asymmetric about that axis, and if desired, can be located on a single side of the longitudinal axis 13.

The particular shape of the vent opening can be of any geometric shape. For example, as shown, it can be of a trapezoidal shape, bounded around its boundaries by a first lateral pad 15 and a second medial pad 17 on opposing sides across the longitudinal axis 13. The opening can be bounded on its lower portion via a lower pad 19. The vent opening near its uppermost portion, close to the finger portions 20, can be bounded by a set of knuckle or other pads 11 associated with the hand dorsal portion 12. These various pads can be stitched, RF welded, sonically welded, fused, glued, adhered or otherwise attached to the hand dorsal portion 12.

The vent opening 60 can generally include a length L and a width W. The length and width can be dictated by the amount of ventilation to be provided from the exterior 98 to the interior 99 of the glove 10. Further, although shown as being a generally contiguous vent opening, the vent opening can be separated into multiple, individual vent openings spanning across different portions of the hand dorsal portion or other parts of the glove 10.

The vent opening can include a first vent end 61 and a second, opposing vent end 62. The first vent end can be located closer to the knuckles or finger portions 20 of the glove while the second vent end 62 can be located closer to the wrist guard 26 and/or cuff portion 16 of the glove 10. The vent opening 60 also can include opposing first 65 and second 67 sides located on opposite sides of the longitudinal axis 13. These opposing sides 65 and 67 can be equal distance from the longitudinal axis, or alternatively, they can be offset at different distances from the longitudinal axis as desired.

The vent opening 60 can be of a first predetermined area. This area can be substantially located on the dorsal portion 12 of the hand, or optionally overlapping other portions of the hand as desired. Generally, this first predetermined area is lesser than a second predetermined area of the panel 50, which overlays all or a portion of the vent opening 60 as described further below. Where the first predetermined area is larger than the second predetermined area, a viewer of the glove from above the longitudinal axis 13 can generally view or see the vent opening 60 extending beyond the portions of the panel 50.

Figure 5:
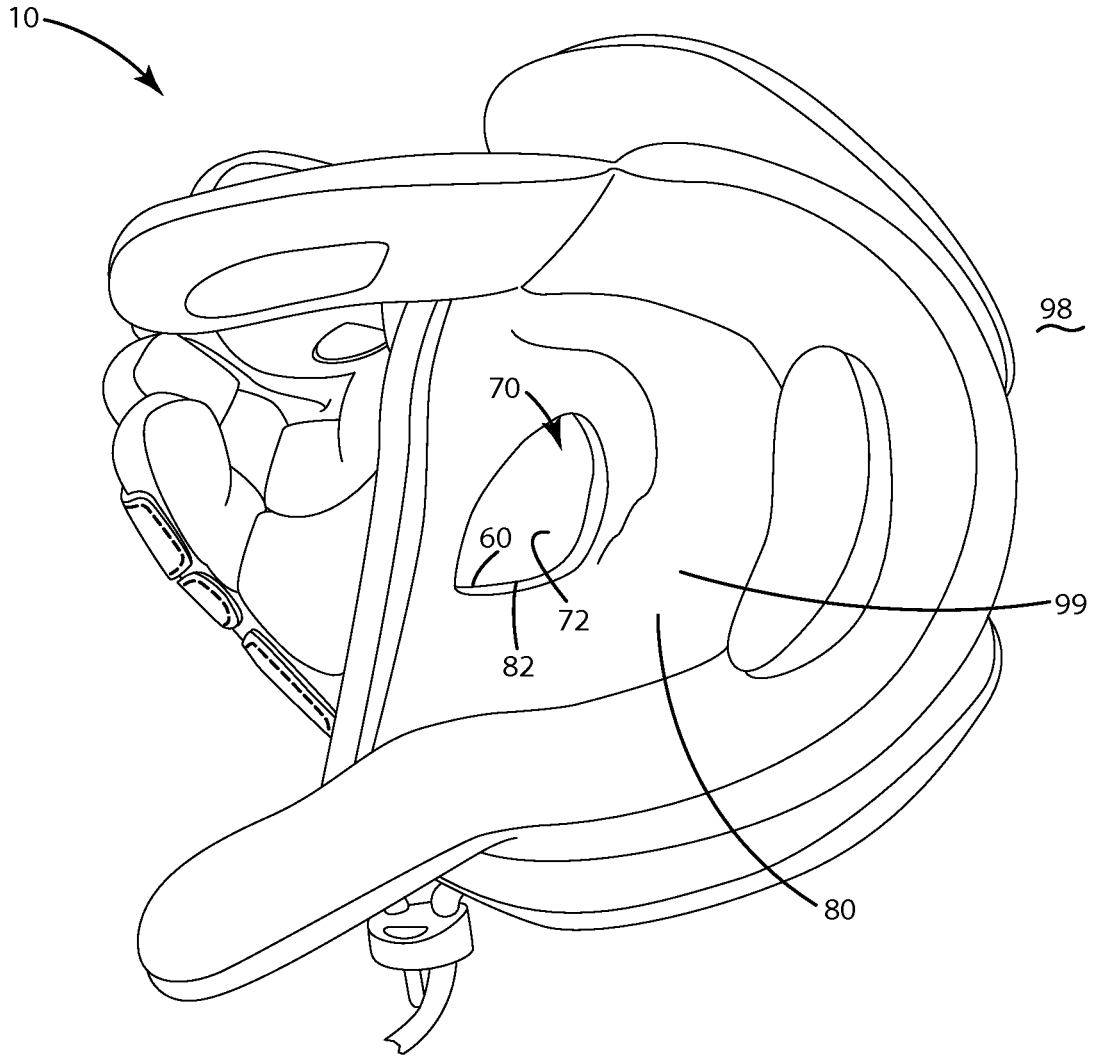
FIG. 5 is a bottom view of the interior of the glove with an interior panel inserted.

The vent opening 60 can be left completely open, or optionally it can be covered with a breathable material 70 extending across its length L and width W to partially or fully cover the vent opening 60. This breathable material 70 can be constructed from any material that allows air to flow from the exterior 98 of the glove to the interior 99 of the glove to provide a level of ventilation to the wearer's hand within the glove 10. For example, the breathable material can be constructed from material such as a mesh, LYCRA®, polyester, Spandex, and open fabric or weave, a screen material, or other like materials that facilitate or allow the relatively free flow of air therethrough. The breathable material 70 can include an upper surface 71 that generally faces toward an exterior 98 of the glove 10. The breathable material can also include an under surface 72 that faces toward an interior 99 of the glove 10, as shown in FIG. 5.

As shown in FIGS. 1-4, the glove 10 includes the panel 50. This panel 50 extends upwardly and over the opening 60 and generally the breathable material 70.

The panel 50 includes a first panel end 51 and a second panel end 52. The first panel end 51 can be located closer to the finger portions 20 than the wrist guard 26 and/or cuff 16 than the second end 52. The first end 51 can be stitched, glued, RF welded, molded, or otherwise fixedly and immovably secured to the dorsal side 12 of the glove. The second panel end 52 likewise can be stitched, glued, RF welded, molded, or otherwise fixedly and immovably secured to the dorsal side of the glove 12 as well. Of course, other modes of such attachment can be implemented, for example, one or both ends can be elastically coupled to the dorsal hand portion or other parts of the glove as desired.

The second end can be located adjacent the wrist guard 26 and/or the cuff portion 16. Optionally, the second end 52 is secured via stitching directly to the junction 95 between the hand portion and the cuff portion. Of course, the second end can be secured in different locations than those shown, farther away or closer, to the knuckle portion. Generally, even when the hand is flexed with this construction, the first and second ends remain attached to and do not move much, if at all, relative to the dorsal portion 12 of the glove. Optionally, neither of these ends are "free" to float relative to the dorsal portion 12 of the hand. In some embodiments, the second end 52 can be secured to the hand dorsal portion under the wrist guard 26 so that that end 52 and the associated attachment devices, for example, a stitch, an RF weld, a seam or elastic or inelastic strap, which are concealed by the wrist guard 26 and/or the cuff portion 16.

As shown in FIG. 2, the panel 50 can include first and second sides 55 and 57. These opposing sides 55 and 57 can be disposed optionally on opposite sides of the longitudinal axis 13, but of course, if desired, they both can be on the same side depending on the particular orientation of the panel relative to the dorsal portion 12. The first panel side 55 can be separated from the medial pad 15 and the second panel side 17 can be separated from the lateral pad 17, each by a predetermined distance along certain portions of the panel sides 15 and 17 so that an opening is formed between those sides and the respective lateral pads 65 and 67. Optionally, these certain portions of the panel sides 55 and 57 can also be separated from certain portions of the lateral side 65 and medial side 67 of the vent opening. In this manner a panel can extend over a portion of the vent opening 60 and breathable material 70, while an additional portion of vent opening and/or breathable material remains exposed and in view when the glove is viewed from above the longitudinal axis 13. Further, in such a construction, the panel can cooperatively cover a substantial portion of the vent opening and/or breathable material, which leaves exposed the first portion 73 and a second portion 74 of the breathable material to the view of a viewer above the longitudinal axis 13.

Although shown as leaving these portions 73 and 74 of the breathable material exposed, the panel and in particular the sides 55 and 57 of the panel can extend farther outwardly, terminating near or adjacent the lateral pads 65 and 67 respectively.

Figure 4:
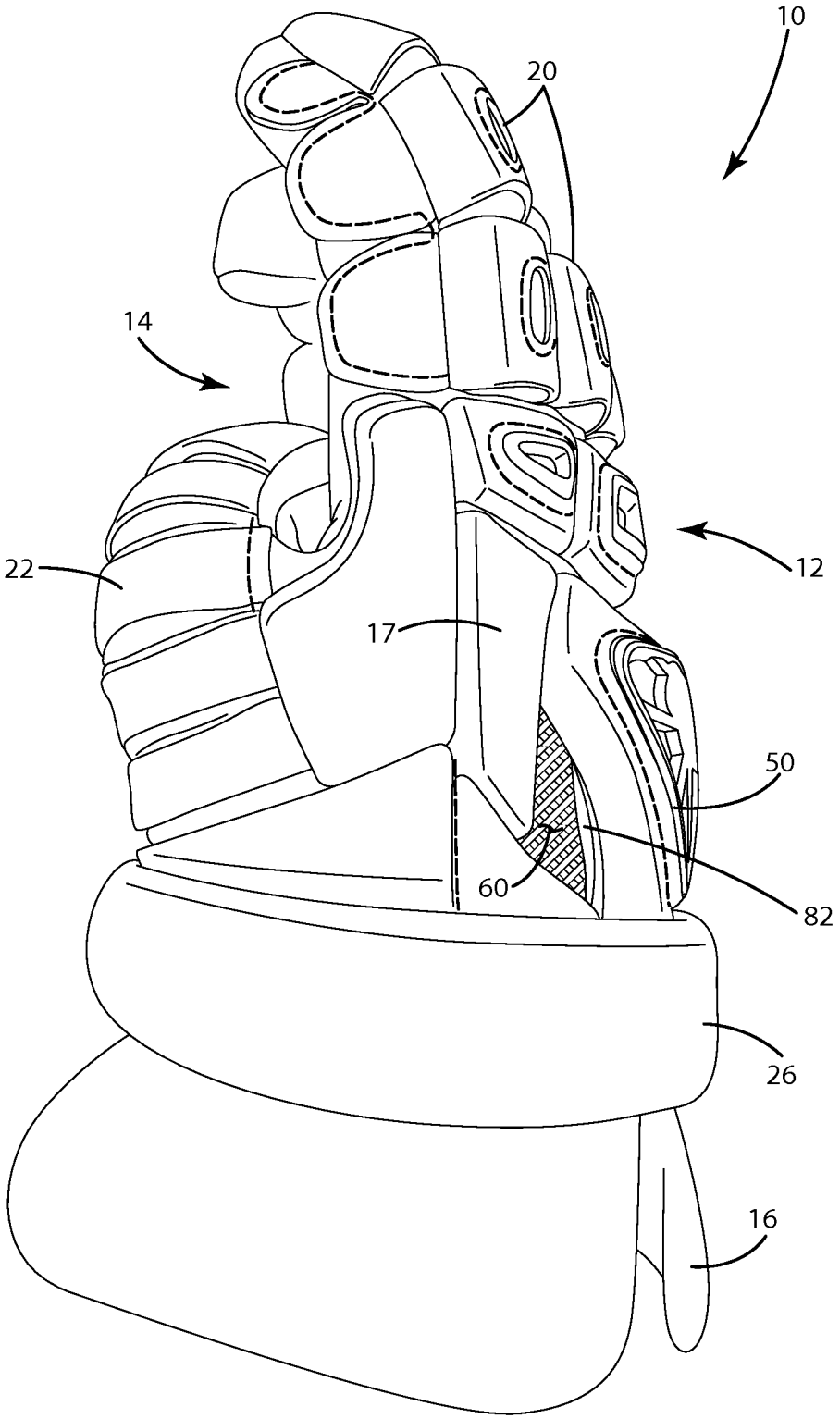
FIG. 4 is a medial side view of the glove.

The panel 58 also can be of an arched configuration or shape which is shown in FIGS. 3 and 4. As shown there, the panel 50 arches upward generally from the first end 51 to the second end 52 so that the panel forms a convex pad or element generally located over the vent opening 60. As shown in FIG. 4, the central portion 55 of the panel 50 is the greater distance D1 from the breathable material 70 and/or vent opening than the first 51 and second 52 ends of the panel at distances D3 and D3'. Optionally, distance D1 can be 2, 3, 4, 5, 10, 20 or more times the distance D3 and D3'. Further optionally, the distances D3 and D3' can be the same, or can be different as desired.

Although shown as a perfectly arcuate panel, the panel 50 can be arched in a different manner. For example, the arched panel can include multiple compound panels joined with one another to step upwardly from the first end toward the central portion 55 and back down to the second end 52. Alternatively, the arched panel can include a first straight or flat portion that angles upwardly away from breathable material 70, a second straight or flat portion near the central portion 55, and a third straight or flat portion near the second end 52 that angles back down toward the vent opening and/or breathable material 70. Any of these straight or flat portions can be readily substituted with one or more curved or rounded portions.

With the arched shape, the panel can provide a void 82 between an undersurface 58 of the panel 50 and the vent opening 60 and/or breathable material 70. This void 82 is generally visible from one or more side views of the glove as shown in FIGS. 3 and 4. The void can generally be positioned between the undersurface 58 of the panel 50 and the upper surface 71 of the breathable material. This void can allow the air to circulate readily underneath the panel 50 and directly into the vent opening 60, and from there, into interior 98 of the glove. This can provide improved ventilation to the back of the wearer's hand generally to the hand of the wearer within the glove 10.

As shown in FIG. 2, the panel 50 can be constructed to include an outer cover 59. Under the cover, a foam pad and/or other plastic or polymeric parts can be included to add rigidity to the panel and support it in its domed or arched shape. The pad panel 50 can also be outfitted with a decoration or other aesthetic feature 79, depending on the particular application. This aesthetic feature 79 might include an opening that extends completely through the panel 50. However, as shown, the panel is of a continuous, fixed configuration with its upper surface being void of any visible openings between the opposing lateral and medial sides or edges 55 and 57. The panel 50 can provide sufficient protection from blows to the back of the hand while still providing an open circulation of air to the vent opening.

As shown in FIGS. 3 and 4, and briefly explained above, the vent opening 50 can include first and second vent ends 51 and 52. The breathable material 70 can be disposed in or over the vent opening. It can extend from the first vent end 51 toward the second vent end 52, with the upper surface 71 of the material being located closer to the wearer's hand than the under surface 58 of the panel 50.

Optionally, the glove 10 can be constructed so that no other structural components are located between the undersurface 58 of the arched panel and the upper surface 72 of the breathable material 70. In this configuration, the arched panel 50 can be free to flex downwardly when impacted by a blow. Accordingly, the initial force F1, as shown in FIG. 3, can be dissipated and split into forces F2 and F3, which are dispersed through the first end 51 and the second end 52. Where the second end 52 is adjacent and/or abuts the wrist guard 26, some of the force F2 can be dissipated into the wrist guard to provide further protection and shock absorption to the underlying hand.

Figure 7:
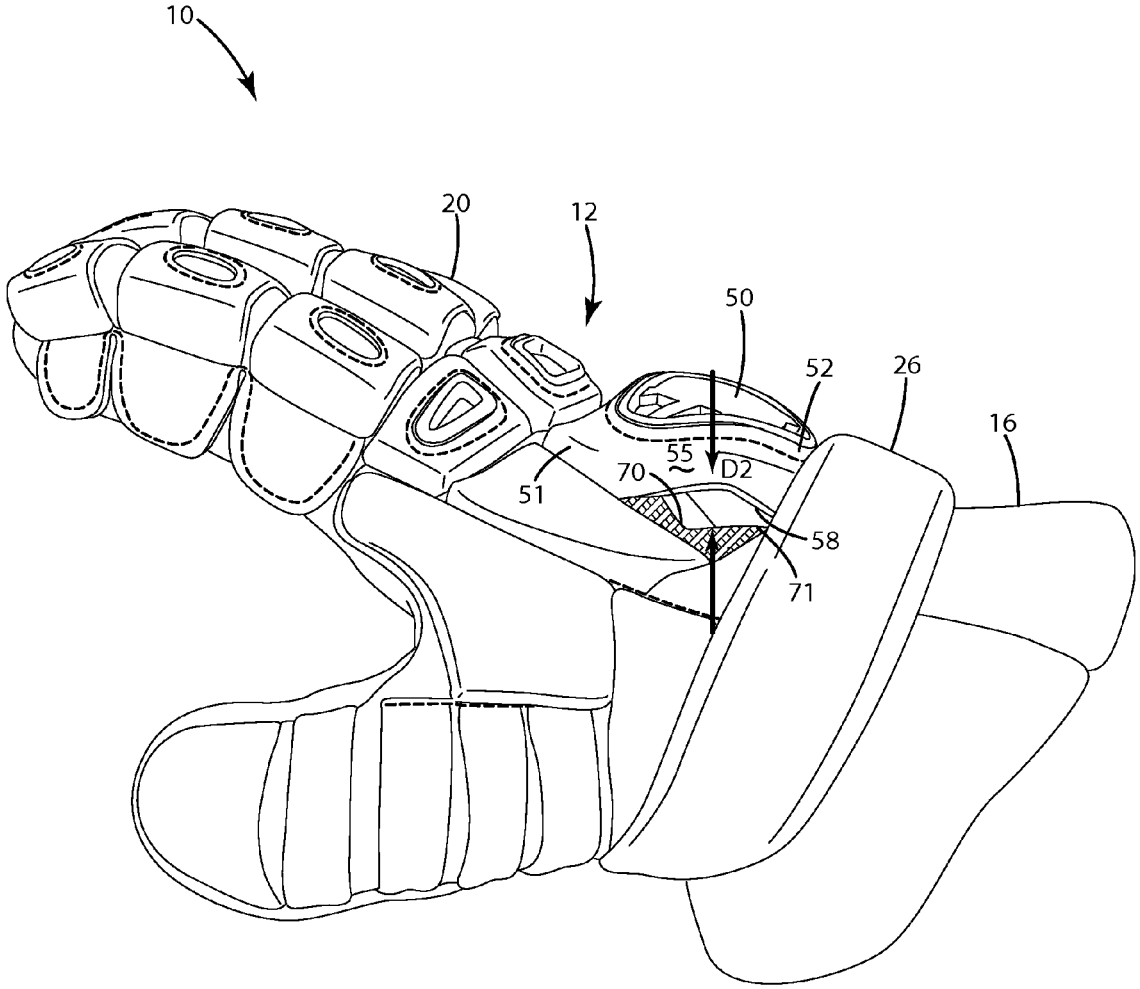
FIG. 7 is a side view of the glove in a rearwardly bent or flexed state with the arched panel farther distanced from the vent opening.

In addition to providing improved ventilation and air flow to the underlying breathable material and/or through the opening 60, the arched construction of the panel 50 can also provide enhanced resistance to hyperextension of the wrist and/or finger portions. For example, with reference to FIG. 7, when the finger portions 20 are brought backward, toward the cuff portion 16 or generally toward the wearer's wrist, the arched panel 50 bends or flexes between the first end 51 and the second end 52. The central portion 55 can bend upwardly away from the breathable material 70 from the first distance D1 (FIG. 3) to a second greater distance D2 (FIG. 7). In other words, when the hand within the glove is in the flexed state as shown in FIG. 7, the central portion 55 can be located a second distance D2, greater than the first distance D1, from the breathable material, when the hand is in the retracted state as shown in FIG. 3. With the bending, the arched configuration of the panel 50 operates to impair or stop further rearward hyperextension of the hand toward the wrist.

To the cuff portion 16, an optional floating subcuff portion 24 can be joined, and optionally substantially contained within the cuff portion 16. The subcuff portion 24 can be secured to the inner side of the cuff portion 16 using one or more elastic members (not shown). The subcuff portion 24 can be attached to the cuff portion 16 in a variety of different ways, that is, with more or fewer elastic or inelastic straps, other compliant material, or at a variety of different locations. Alternatively, the subcuff portion 24 can be flexibly attached to other portions of the glove 10. An optional subcuff portion 24 that can be used with the protective sports glove 10 is described in U.S. Pat. No. 7,636,951, and entitled "Protective Sports Glove with Floating Cuff Portion," which is incorporated by reference herein.

As further shown in FIG. 5, the interior 99 of the glove 10 optionally can be configured with a removable liner 80 that defines an opening 82. The opening 82 can be aligned with all or a portion of the breathable material 70 and/or vent opening 60. In this manner, the opening 82 can provide open air circulation to the back of the wearer's hand when in the glove 10.

Figure 6:
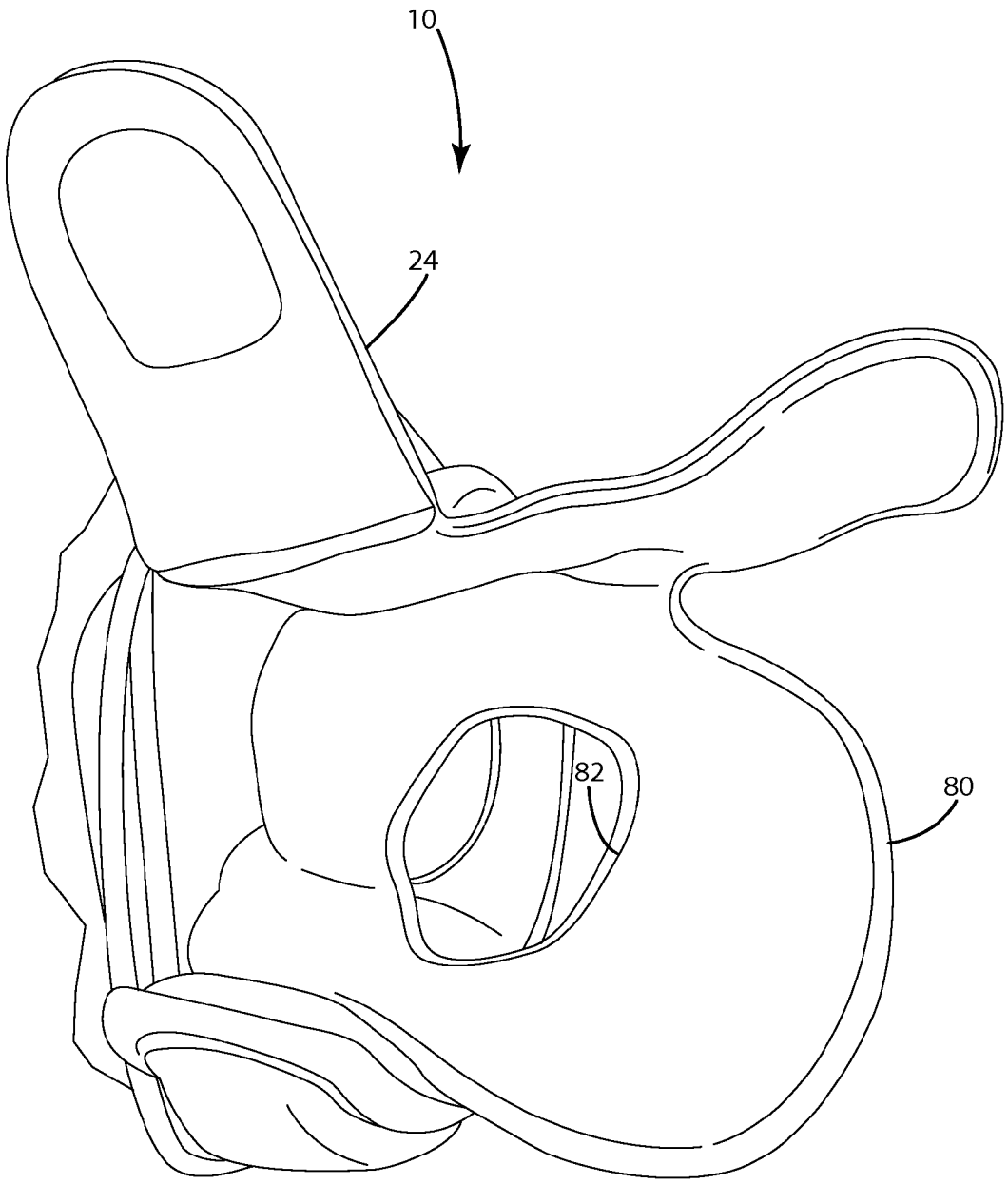
FIG. 6 is a bottom view of the glove with the interior panel removed.

FIG. 5 shows the removable liner installed which the interior 99 of the glove 10. FIG. 6 shows the removable liner 80 removed to a removed state from the glove 10. The removable liner as shown there better illustrates the opening 82, which again when installed on the interior 99 of the glove, aligns with the breathable material 70 and/or vent opening 60 to provide enhanced ventilation to the interior of the glove. The removable liner 80 can include one or more attachment members such as velcro, adhesives or other elements to temporarily secure the removable liner within the interior of the glove. In operation, a wearer can remove the liner 80 from the glove to the configuration shown in FIG. 6 to allow it to dry out any perspiration that may have become embedded in or on the liner 80.

While the protective glove 10 of the present invention is directed to the sports of hockey and lacrosse, the protective glove 10 can also be utilized in a wide variety of sports, or occupational activities, in which protection to the hand or wrist is desired. Moreover, the particular shape of the panel, vent opening and breathable material is not limited to the actual shape depicted, but can cover many similar variations that provide protection to the hand and ventilation as well.

All patents, patent applications, and literature references cited in this specification are hereby incorporated herein by reference in their entirety. In case of conflict, the present description, including definitions, will control.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A protective sports glove comprising:

a hand portion including a hand palmar portion and an opposing hand dorsal portion having a longitudinal axis;

a finger portion joined with and extending from the hand portion;

a thumb portion joined with and extending from the hand portion;

a cuff portion joined with the hand portion at a junction; and a wrist guard joined with at least one of the hand portion and the cuff portion adjacent the junction;

a vent opening defined by the hand dorsal portion, the vent opening extending laterally across the hand dorsal portion and extending longitudinally along the longitudinal axis;

a breathable material disposed across the vent opening so that air can circulate toward and away from a user's hand when the hand is disposed in the glove, a panel joined with the hand dorsal portion, the panel having a first end, a second end distal from the first end, and first and second opposing sides, wherein the first end of the panel is fixedly secured to the hand dorsal portion adjacent the finger portion with at least one of a first stitching, glue, a weld, a molded part, an elastic coupler and combinations thereof, wherein the second end of the panel is fixedly secured to the hand dorsal portion adjacent at least one of the cuff portion and the wrist guard with at least one of a second stitching, glue, a weld, a molded part, an elastic coupler and combinations thereof, wherein the panel is of an arch shape and is positioned over the vent opening and the breathable material so as to provide an open void above the breathable material so that air can generally freely enter and exit the vent opening, flowing under the panel, wherein the panel is configured to flex upwardly, away from the breathable material, when the user's hand flexes rearward toward a wrist of the user.

2. The protective sports glove of claim 1 wherein the breathable material extends laterally beyond the first and second opposing sides of the panel and is visible when the panel is viewed from above the longitudinal axis.

3. The protective sports glove of claim 1 wherein the first end is fixedly and immovably joined with the hand dorsal portion adjacent a base of the finger portion of the glove.

4. The protective sports glove of claim 3 wherein the second end is fixedly and immovably joined to the hand dorsal portion under the wrist guard.

5. A protective sports glove comprising:

a hand portion including a hand palmar portion and an opposing hand dorsal portion having a longitudinal axis;

a finger portion joined with and extending from the hand portion;

a thumb portion joined with and extending from the hand portion;

a cuff portion joined with the hand portion at a junction; and a wrist guard joined with at least one of the hand portion and the cuff portion adjacent the junction;

a vent opening defined by the hand dorsal portion, the vent opening extending laterally across the hand dorsal portion and extending longitudinally along the longitudinal axis;

a breathable material disposed across the vent opening so that air can circulate toward and away from a user's hand when the hand is disposed in the glove, a panel joined with the hand dorsal portion, the panel having a first end, a second end distal from the first end, and first and second opposing sides, wherein the first end of the panel is fixedly secured to the hand dorsal portion adjacent the finger portion, wherein the second end of the panel is fixedly secured to at least one of the hand dorsal portion and the cuff portion adjacent the wrist guard, wherein the panel is of an arch shape and is positioned over the vent opening and the breathable material so as to provide an open void above the breathable material so that air can generally freely enter and exit the vent opening, flowing under the panel, wherein the panel is configured to flex upwardly, away from the breathable material, when the user's hand flexes rearward toward a wrist of the user, wherein the dorsal hand portion includes a first lateral pad and a second lateral pad, the first lateral pad bounding a first side of the vent opening, the second lateral pad bounding a second side of the vent opening on an opposite side of the longitudinal axis from the first side of the vent opening, wherein the first side of the panel is disposed closer to the longitudinal axis than the first lateral pad so as to expose a first portion of the breathable material when viewed from above the longitudinal axis, and wherein the second side of the panel is disposed closer to the longitudinal axis than the second lateral pad so as to expose a second portion of the breathable material when viewed from above the longitudinal axis, wherein the first portion of the breathable material and the second portion of breathable material are joined with one another.

6. The protective sports glove of claim 1 wherein the open void between the panel and the breathable material includes no other components located between a lower surface of the panel and an upper surface of the breathable material.

7. The protective sports glove of claim 6 wherein the second end of the panel terminates under the wrist guard.

8. A protective sports glove comprising:

a hand portion including a hand palmar portion and an opposing hand dorsal portion having a longitudinal axis;

a finger portion joined with and extending from the hand portion;

a thumb portion joined with and extending from the hand portion;

a cuff portion joined with the hand portion at a junction; and a wrist guard joined with at least one of the hand portion and the cuff portion adjacent the junction;

a vent opening defined by the hand dorsal portion, the vent opening extending laterally across the hand dorsal portion and extending longitudinally along the longitudinal axis;

a breathable material disposed across the vent opening so that air can circulate toward and away from a user's hand when the hand is disposed in the glove, a panel joined with the hand dorsal portion, the panel having a first end, a second end distal from the first end, and first and second opposing sides, wherein the first end of the panel is fixedly secured to the hand dorsal portion adjacent the finger portion, wherein the second end of the panel is fixedly secured to at least one of the hand dorsal portion and the cuff portion adjacent the wrist guard, wherein the panel is of an arch shape and is positioned over the vent opening and the breathable material so as to provide an open void above the breathable material so that air can generally freely enter and exit the vent opening, flowing under the panel, wherein the panel is configured to flex upwardly, away from the breathable material, when the user's hand flexes rearward toward a wrist of the user, wherein the panel and a stitching and an optional plastic part are the only structures covering the breathable material.

9. A protective sports glove, comprising:

a hand portion including a hand palmar portion and an opposing hand dorsal portion having a longitudinal axis;

a finger portion joined with and extending from the hand portion;

a thumb portion joined with and extending from the hand portion;

an opening defined in the hand dorsal portion, the opening including a first end and a second end distal from the first end along the longitudinal axis, the opening having a length and a width, the opening extending laterally across the hand dorsal portion and extending longitudinally along the longitudinal axis, and at least one arched panel extending upwardly in an arched configuration over the opening, the panel including a first panel and fixedly secured to the hand dorsal portion adjacent the first end, and a second panel end fixedly secured to the hand dorsal portion adjacent the second end, wherein the panel extends from the first end to the second end along the entire length of the opening, wherein the arched panel forms a visible void above the opening when the glove is viewed from a side view.

10. The protective sports glove of claim 9 comprising a breathable material extending from the first end to the second end, the breathable material disposed under an undersurface of the arched panel.

11. The protective sports glove of claim 10 wherein the visible void is formed between an upper surface of the breathable material and the undersurface of the arched panel, with no other structural components located between the undersurface of the arched panel and the upper surface of the breathable material.

12. The protective sports glove of claim 9 comprising a cuff portion joined to the hand portion at a junction and a wrist guard covering the junction, wherein the second panel end is secured to the hand dorsal portion under the wrist guard.

13. The protective sports glove of claim 9 wherein the second panel end is secured to the hand dorsal portion with at least one of a stitching, glue, a weld, a molded part, an elastic coupler and combinations thereof.

14. A protective sports glove, comprising:

a hand portion including a hand palmar portion and an opposing hand dorsal portion;

a finger portion joined with and extending from the hand portion;

a thumb portion joined with and extending from the hand portion;

an opening defined in the hand dorsal portion, the opening including a first end and a second end distal from the first end along a longitudinal axis, the opening having a length and a width; and at least one arched panel extending upwardly in an arched configuration over the opening, the panel including a first panel end fixedly secured to the hand dorsal portion adjacent the first end, and a second panel end fixedly secured to the hand dorsal portion adjacent the second end, wherein the panel extends from the first end to the second end along the entire length of the opening, wherein the arched panel forms a visible void above the opening when the glove is viewed from a side view, wherein the dorsal hand portion includes a first lateral pad and a second lateral pad, the first lateral pad bounding a first side of the opening, the second lateral pad bounding a second side of the opening on an opposite side of the longitudinal axis from the first side of the opening;

wherein the panel includes a first panel side disposed closer to the longitudinal axis than the first lateral pad so as to expose a first portion of the material when viewed from above the longitudinal axis, and wherein the panel includes a second panel side disposed closer to the longitudinal axis than the second lateral pad so as to expose a second portion of the material when viewed from above the longitudinal axis.

15. The protective sports glove of claim 11 comprising a breathable material extending laterally beyond opposing sides of the arched panel, the breathable material being visible when the panel is viewed by a viewer from above the longitudinal axis.

16. A protective sports glove, comprising:

a hand portion including a dorsal side having a longitudinal axis;

a finger portion joined with and extending from the hand portion;

a thumb portion joined with and extending from the hand portion;

a cuff portion joined with the hand portion;

an opening defined by the dorsal side of the hand portion, the opening extending laterally across the dorsal side and extending longitudinally along the longitudinal axis;

a material extending across the opening;

an arched panel including a first end and a second end, the panel including a first panel end fixedly and immovably secured to the dorsal side, and a second panel end fixedly and immovably secured to at least one of the hand dorsal portion and the cuff portion, wherein the arched panel includes an upper surface and opposing lateral and medial edges disposed on opposite sides of the longitudinal axis, the lateral and medial edges forming first and second outer boundaries of the arched panel, wherein the arched panel is disposed a distance above the material so as to form a visible void between an undersurface of the arched panel and the material when the glove is viewed by a viewer from a side view, wherein the opening includes a medial outer portion and a lateral outer portion, wherein the medial outer portion extends outwardly, away from the longitudinal axis, the medial outer portion extending laterally beyond the medial edge of the arched panel, wherein the lateral outer portion extends outwardly, away from the longitudinal axis, the lateral outer portion extending laterally beyond the lateral edge of the arched panel.

17. The protective sports glove of claim 16 wherein the upper surface of the arched panel is void of any visible openings extending through the arched panel located between the opposing lateral and medial edges.

18. The protective sports glove of claim 16 wherein the panel includes a central portion located between the first end of the panel and the second end of the panel, where the central portion is located a first distance from the material when a hand within the glove is in flexed state, wherein the central portion is located a second distance, greater than the first distance, from the material when the hand is in a retracted state.

19. The protective sports glove of claim 16 comprising a wrist guard joined with the hand portion, wherein the second end of the arched panel is secured to the dorsal side adjacent the wrist guard, wherein the arched panel includes a padding layer.

* * * * *